United States Patent [19]

Ogiri et al.

[11] Patent Number: 4,730,205

[45] Date of Patent: Mar. 8, 1988

[54] TONER COLLECTING APPARATUS

[75] Inventors: Tadakazu Ogiri, Osaka; Yoshiaki Yanagida, Hirakata; Yasuyuki Ishiguro, Osaka; Hirofumi Ozaki, Sakai; Takashi Maekawa, Osaka; Tetsuya Matsushita, Osaka; Kiyoshi Shibata, Osaka; Kiyoshi Morimoto, Osaka, all of Japan

[73] Assignee: Mita Industrial Co. Ltd., Osaka, Japan

[21] Appl. No.: 903,348

[22] Filed: Sep. 3, 1986

[30] Foreign Application Priority Data

Sep. 5, 1985 [JP] Japan ..... 60-196338

[51] Int. Cl.[4] ..... G03G 21/00

[52] U.S. Cl. ..... 355/15; 118/652

[58] Field of Search ..... 355/15, 3 DD; 118/652, 118/653

[56] References Cited

U.S. PATENT DOCUMENTS

| | | | |
|---|---|---|---|
| 4,099,861 | 7/1978 | Abel | 355/15 |
| 4,140,389 | 2/1979 | Franke et al. | 355/15 |
| 4,251,155 | 2/1981 | Schnall et al. | 355/15 |
| 4,390,268 | 6/1983 | Furuichi et al. | 355/15 |
| 4,483,606 | 11/1984 | Kuwako et al. | 355/15 X |
| 4,500,196 | 2/1985 | Shimura | 355/3 |
| 4,538,896 | 9/1985 | Tajima et al. | 355/3 R |
| 4,551,000 | 11/1985 | Kanemitsu et al. | 355/3 R |
| 4,552,451 | 11/1985 | Yamakazi et al. | 355/15 |
| 4,561,766 | 12/1985 | Foy | 355/15 |

FOREIGN PATENT DOCUMENTS

| | | | |
|---|---|---|---|
| 86112329 | 7/0000 | European Pat. Off. | 04001984/DEX |
| 2207843 | 6/1974 | France . | |
| 56-77880 | 6/1981 | Japan . | |
| 57-201278 | 12/1982 | Japan | 355/15 |
| 58-139170 | 8/1983 | Japan . | |
| 59-36276 | 2/1984 | Japan | 355/15 |
| 60-108877 | 6/1985 | Japan . | |
| 60-120384 | 6/1985 | Japan . | |
| 60-162277 | 8/1985 | Japan | 355/15 |
| 60-165679 | 8/1985 | Japan | 355/15 |
| 60-230178 | 11/1985 | Japan . | |

*Primary Examiner*—Arthur T. Grimley
*Assistant Examiner*—J. Pendegrass
*Attorney, Agent, or Firm*—Beveridge, DeGrandi & Weilacher

[57] ABSTRACT

Toner collecting apparatus in which a toner collecting container for collecting toner remaining on the surface of a photosensitive drum in a copying machine or a facsimile machine is provided, at the lower side thereof, with a toner receiving port, a sponge roller for rotatingly feeding collected tone disposed adjacent the toner receiving port, and an optical detector for detecting that a predetermined amount or more toner has been collected in the toner collecting container. The optical detector, is disposed on the toner collecting container. At least those portions of the toner collecting container located opposite to the optical detector are made of a light-permeable material.

8 Claims, 17 Drawing Figures

TONER COLLECTING APPARATUS

BACKGROUND OF THE INVENTION

The present invention relates to a toner collecting apparatus for collecting toner remaining on the surface of a photosensitive drum in a copying machine or a facsimile machine.

Conventionally, there is known a toner collecting apparatus for collecting toner remaining on the surface of a photosensitive drum in a copying machine or the like in which toner collected from the surface of the photosensitive drum is conveyed to a predetermined position through a toner discharging case and is let fall spontaneously released in a toner collecting container which is made of transparent plastic and can be mounted on the main body of a copying machine. An optical sensor having a light emitting portion and a light receiving portion located opposite to the light emitting portion is disposed on the toner collecting container as mounted on the main body, the sensor being adapted to detect that the amount of toner collected in the toner collecting container has reached a predetermined amount. Further, a cleaning member is disposed for cleaning those portions of the toner collecting container opposite to the light emitting portion and the light receiving portion, such cleaning being made automatically in association with the mounting of the toner collecting container on the main body of the copying machine at a predetermined position (Japanese Patent Laid-Open Publication No. 116568/1983).

In the toner above-mentioned collecting apparatus, the portions of the toner collecting apparatus between the light emitting portion and the light receiving portion can be cleaned only when the toner collecting container is mounted on the main body of the copying machine at its predetermined position, and cannot be cleaned at all while the toner collecting operation is carried out.

While the toner collecting operation is carried out, toner falls spontaneously. Therefore, when toner reaches the lowest portion of the toner collecting container, the toner scatters as a reaction and such scattering toner sticks to the inner surface of the transparent toner collecting container.

Therefore, even though the toner collecting container was cleaned at the time the toner collecting container was mounted on the main body of the copying machine, the toner collecting container to which toner sticks afterward cannot be cleaned. Accordingly, even through the amount of toner collected is still relatively small, the light passage between the light emitting portion and the light receiving portion may be obstructed by scattering or sticking toner so that the optical sensor may erroneously judge that the amount of toner collected has reached a predetermined amount.

Conventionally, there is known another toner collecting apparatus in which a photosensitive drum and a toner collecting container for housing toner collected from the photosensitive drum are formed in a unitary construction which can be used as an expandable unit (Japanese Patent Laid-Open Publication No. 154255/1982).

In the expendable unit above-mentioned, the photosensitive drum and the toner collecting container are integrally mounted on an arm and removably attached to the main body of a copying machine. The total amount of toner collected when the photosensitive drum has been used as much as the liftime number of rotations of the photosensitive drum is calculated. The volume of the toner collecting container is set such that the toner collecting container can house the toner amount thus calculated. Therefore, when the number of actual rotations of the photosensitive drum reaches its lifetime number of rotations above-mentioned, the expendable unit is to be replaced.

However, the amount of toner remaining on the surface of the photosensitive drum after the photosensitive drum is used one, varies with various conditions such as the contents or size of an original document, a preset copying density, a temperature, a charged amount of the photosensitive drum which is electrified due to ambient humidity, and the amount of transferred toner. Therefore, even though the number or actual rotations of the photosensitive drum has reached its lifetime number of rotations, the total amount of toner actually collected may be significantly different from the calculated amount of toner above-mentioned.

If the amount of toner actually collected is greater than the calculated amount of toner to be collected, the toner collecting container is almost filled up with collected toner, even though the number of actual rotations of the photosensitive drum does not reach its lifetime number of rotations. Therefore, the toner collecting container has no more space for housing collected toner and the collected toner disadvantageously overflows from the toner collecting container. Since a relatively less expensive toner collecting container cannot be used, it becomes necessary to replace the expendable unit with a new one even though an expensive photosensitive drum might still be fit for use. This means that an expendable unit which might still be fit for use, is discarded and the cost to be borne by the user is increased.

Conventionally, there is known a further toner collecting apparatus in which a toner collecting container is disposed adjacent the photosensitive drum and a screw conveyor or the like for conveying toner is used (Japanese Utility Model Laid-Open Publication No. 178169/1983).

Such toner collecting apparatus includes a cleaning blade for scraping away toner remaining on the surface of the photosensitive drum, and a seal blade for receiving toner scraped away by the cleaning blade, the seal blade located under and opposite to the cleaning blade. This toner collecting apparatus further includes a rotatable toner scraping plate or a toner discharging belt so that this plate or belt comes in contact with the top surface of the seal blade, and a toner collecting container downstream of the toner scraping plate or the toner discharging belt.

In this toner collecting apparatus, toner scraped away by the cleaning blade can be guided to the toner collecting container adjacent the photosensitive drum. Such arrangement shortens the toner conveying distance, thereby to enable to significantly reduce a stain inside of the main body of a copying machine by toner.

In this toner collecting apparatus, however, toner is merely moved toward the toner collecting container by the toner scraping plate or the toner discharging belt. Therefore, toner can be actually housed in the toner collecting container only at its area lower than the toner scraping plate or the toner discharging belt. Therefore, the amount of toner to be collected is disadvantageously reduced.

A strong demand for a smaller-size copying machine, a facsimile machine or the like has increased. In order to satisfy such demand, a passage for conveying copying paper is disposed as close to the lower surface of the photosensitive drum as possible. It is therefore required that the height of the toner collecting container to be disposed adjacent the photosensitive drum, in particular the bottom of the toner collecting container, does not interfere the paper conveying passage. Further, in order to let toner scraped by the cleaning blade effectively fall onto the seal blade and to prevent the falling toner from staying thereon, the toner scraping plate or the toner discharging belt is located in a position which is separted by a predetermined distance from the photosensitive drum and opposite to the substantially center part thereof. Therefore, the volume of the area of the toner collecting container lower than the toner scraping plate or the toner discharging belt is inevitably reduced to accordingly reduce the amount of toner to be collected.

Conventionally, the seal blade for receiving toner scraped away from the surface of the photosensitive drum is securely bonded to a blade holder and is attached to the lower wall of a toner receiving port of the toner collecting container with setscrews through a pressing members having slots such that the contact pressure and the distance between the tip of the seal blade and the photosensitive drum can be adjusted.

In transporting a copying machine or the like having such seal blade as above-mentioned, if the seal blade is in contact with the photosensitive layer of the photosensitive drum at the same position for a long period of time, external vibration may provoke cracks in the photosensitive layer of the photosensitive drum and the tip of the seal blade may be deformed. This may reduce the quality of a copied image and produce a gap between the seal blade and the surface of the photosensitive drum. Therefore, toner scraped away from the photosensitive drum disadvantageously comes out to the outside of the toner collecting container.

At the time of transport of toner collecting apparatus having such a conventional seal blade, the setscrews are once loosened and the seal blade together with the blade holder is moved along the slots of the pressing members, and the setscrews are then tightened to fit the seal blade such that the seal blade is kept away from the photosensitive drum. In use of this toner collecting apparatus, the seal blade together with the blade holder is moved up to the predetermined position so that the tip of the seal blade comes in contact with the photosensitive layer of the photosensitive drum.

In such conventional toner collecting apparatus, however, it is required to rotate the setscrews in order to move the seal blade to a predetermined position such that the tip of the seal blade comes in contact with the photosensitive layer of the photosensitive drum or is kept away from the photosensitive drum. This disadvantageously requires much labor of mounting works. Further, if the seal blade is set at a predetermined position with the setscrews tightened insufficiently, the seal blade will be gradually moved together with the blade holder, so that the tip of the seal blade is separated from the surface of the photosensitive drum. This may introduce the problem that toner scraped away from the photosensitive drum falls outside of the toner collecting container.

Further, in a transfer device for transferring to copying paper a toner image formed on the photosensitive drum, there are instances where copying paper to which the toner image has been transferred is not separated from the photosensitive drum by a separating device and enters the toner collecting apparatus along the photosensitive drum. In such case, the rotation of the photosensitive drum causes the tip of the copying paper to come in contact with the lower end of the cleaning blade, so that the copying paper is bent. The bend causes the tip of the seal blade to be pushed to the toner feeding member for conveying toner to the toner collecting container. The seal blade is therefore deformed. At this time, the toner feeding member is rotated in the same direction to the rotating direction of the photosensitive drum. The tip of the seal blade is therefore rolled in the toner feeding member and extremely bent. The seal blade once rolled in and deformed by the toner feeding member cannot be perfectly restored as to contact pressure to the surface of the photosensitive drum even though the deformed portion is repaired. Therefore, such deformed seal blade cannot be used.

SUMMARY OF THE INVENTION

It is an object of the present invention to provide a toner collecting apparatus which can eliminate a bad influence exerted by the scattering of toner and securely detect the amount of toner collected.

Another object of the present invention is to provide a toner collecting apparatus which can eliminate wasteful replacement of photosensitive drum which is still fit for use, thereby to decrease the cost to be borne by the user.

A further object of the present invention is to provide a toner collecting apparatus having a toner collecting container which can collect toner substantially at its entire area.

A still further object of the present invention is to provide a toner collecting apparatus which can be securely set at a predetermined position with simple operations.

It is a still further object of the present invention to provide a toner collecting apparatus having a seal blade arranged so as not to be rolled in a toner feeding member.

In order to achieve the objects above-mentioned, the toner collecting apparatus in accordance with the present invention comprises a photosensitive drum on which an electrostatic latent image is formed, a cleaning blade for scraping away toner remaining on the surface of the photosensitive drum, a seal blade for receiving toner scraped, and a toner collecting container for collecting toner received. The toner collecting container has a toner receiving port at a predetermined position of the lower side thereof. Disposed adjacent this toner receiving port is a toner feeding member for conveying toner received to the toner collecting container. An optical detector is disposed on the toner collecting container. At least those portions of the toner collecting container which are located opposite to the optical detector, are made of a light-permeable material.

According to the toner collecting apparatus above-mentioned, toner collected can be fed into the inside of the toner collecting container through the toner receiving port by the toner feeding member. Since toner is sent into the inside of the toner collecting container from the lower portion thereof, the top surface of toner accumulated is gradually lifted and will finally intercept the light passing between the light emitting portion and the light receiving portion of the optical sensor. Therefore, it can be detected that a predetermined amount of toner has been collected in the toner collecting container. The toner collecting apparatus in accordance with the present invention can securely detect the collection of predetermined amount of toner without a possibility of erroneous detection due to the scattering of toner.

According to the toner collecting apparatus of the present invention, the light emitting portion and the light receiving portion of the optical sensor are disposed respectively in a pair of concaved portions formed at the upper portion of the toner collecting container. At least those portions of the concaved portions located between the light emitting portion and the light receiving portion may be made of a light-permeable material. The toner collecting apparatus having such arrangement can assure the same operating result as above-mentioned.

When the toner feeding member is a sponge roller made of a porous material to be elastically deformed, toner which has once entered small holes in the sponge roller can be pressed out and then guided to the inside of the toner collecting container. In spite of the rotation of the sponge roller, such arrangement can prevent toner from scattering even through the amount of toner collected in the toner collecting container is small. When the amount of toner collected in the toner collecting container is increased, toner can be also guided securely into the toner collecting container. Such arrangement further eliminates erroneous detection by the optical sensor, thus assuring accurate detection of collection of toner of a predetermined amount.

In a toner collecting apparatus in accordance with another embodiment of the present invention, the photosensitive drum and the toner collecting container for housing residual toner scraped away from this photosensitive drum are formed in a unitary structure and removably mounted on the main body of a copying machine. When the number of actual rotations of the photosensitive drum reaches its lifetime number of rotations, the photosensitive drum and the toner collecting container can be replaced. The toner collecting container has an outlet port through which toner collected can be taken out. There is also disposed a sensor for detecting that the amount of toner collected in the toner collecting container has reached a predetermined amount.

According to this toner collecting apparatus, the amount of toner collected in the toner collecting container is detected by the sensor. When the amount of toner collected in the toner collecting container reaches a predetermined amount before the number of actual rotations of the photosensitive drum reaches its lifetime number of rotations, a suitable amount of toner collected in the toner collecting container can be taken out through the outlet port. Therefore, a toner housing space can be provided in the toner collecting container and the photosensitive drum can be used until the number of actual rotations of the photosensitive drum reaches it lifetime number of rotations. Accordingly, even though the toner collecting container cannot be used, it is not necessary to replace the photosensitive drum which can be still fit for use. This eliminates waste replacement of a photosensitive drum which is still fit for use, and reduces the cost to be borne by the user. The photosensitive drum can therefore be efficiently used.

A toner collecting apparatus in accordance with a further embodiment of the present invention includes a rotation detector for detecting the rotation of the photosensitive drum, a counter for receiving a signal from the rotation detector to count the number of rotations of the photosensitive drum, a control circuit for receiving a signal from the counter and a signal from a sensor for detecting the amount of toner collected in the toner collecting container, a lifetime display for indicating, based a signal from the control circuit, that the number of actual rotations of the photosensitive drum has reached its lifetime number of rotations, and a display for indicating, based on a signal from the control circuit, that the amount of toner collected in the toner collecting container has reached a predetermined amount.

In the toner collecting apparatus above-mentioned, when the number of actual rotations of the photosensitive drum does not reach yet its lifetime number of rotations although the display indicates that the amount of toner collected in the toner collecting container has reached a predetermined amount, a suitable amount of toner collected in the toner collecting container can be taken out and the photosensitive drum can be continuously used as it is. When the lifetime display indicates that the number of actual rotations of the photosensitive drum has reached its lifetime number of rotations, it is sufficient to replace the photosensitive drum. The photosensitive drum can therefore be used efficiently.

In a toner collecting apparatus in accordance with a still further embodiment of the present invention, the upper end edge of the toner receiving port is pressure-contacted with the toner feeding member, and the lower end edge of the toner receiving port is adjacent the toner feeding member. The toner feeding member is rotatingly driven in a direction from the lower end edge of the toner receiving port to the upper end edge thereof.

In a toner collecting apparatus in accordance with a stil further embodiment of the present invention, likewise the toner collecting apparatus above-mentioned, the upper end edge of the toner receiving port is pressure-contacted with the toner feeding member and the outer surface of the lower end edge of the toner receiving port is adjacent the toner feeding member. The inner surface of the lower end edge of the toner receiving port is downwardly inclined. The toner feeding member is rotatingly driven in a direction from the lower end edge of the toner receiving port to the upper end edge thereof.

In these two toner collecting apparatus above-mentioned, the toner feeding member can feed collected toner toward the toner receiving port and then discharge such toner in a direction substantially tangential with respect to the toner feeding member through a space between the lower end edge of the toner receiving port and the toner feeding member. At this time, if the amount of toner in the toner collecting container is still small, the toner thus discharged falls onto the bottom of the toner collecting container. When the amount of toner collected in the toner collecting container is increased to a level higher than the toner receiving port, the downwardly inclined portion of the inner surface of the lower end edge of the toner receiving port causes the dead load of toner to be directed toward the center of the toner collecting container. The dead load of toner hardly acts between the toner feeding member and the lower end edge of the toner receiving port. The discharging force of the toner feeding member overcomes that portion of the dead load of the toner in the toner collecting container which acts on the toner discharging port. Therefore, collected toner can be sent into the toner collecting container. Accordingly, regardless of the amount of toner collected in the toner collecting container, toner can be sent into the toner collecting container from the lower portion thereof. Since substantially the entire volume of the toner collecting container can be utilized for housing toner collected, the amount of toner to be collected can be increased even though the vertical distance between the bottom of the toner collecting container and the toner feeding member, becomes small.

In the two toner collecting apparatus above-mentioned, when the toner feeding member is a sponge roller made of a porous material to be elastically deformed, force in a direction tangential with respect to the sponge roller is exerted on the toner and, at the discharging port, such force can be exerted on the toner substantially uniformly. Therefore, toner can be further securely sent into the toner collecting container and the substantially entire volume of the toner collecting container can be utilized for housing toner.

In a toner collecting apparatus in accordance with a still further embodiment of the present invention, either the inner surfaces of the both lateral plates of the toner collecting container at the toner receiving port, or both end surfaces of a blade holder on which the seal blade is mounted, are provided with guide grooves for guiding the other surfaces. These guide grooves have recesses. The other surfaces above-mentioned have projuctions which engage in the recesses. With these arrangement, the blade holder can be removably mounted on the toner collecting container.

According to this toner collecting apparatus, both ends of the blade holder on which the seal blade is mounted, are inserted into and slide along the guide grooves of the lateral plates of the toner collecting container to engage the projections in the recesses of the grooves, so that the seal blade is mounted on the lateral plates of the toner collecting container. Accordingly, the mere insertion and movement of both ends of the blade holder into and along the guide grooves in the inner surface of the lateral plates of the toner collecting container enable the projections and recesses to be engaged with each other. Therefore, the accurate mounting of the seal blade on a predetermined position is assured and such mounting is significantly facilitated.

In the toner collecting apparatus above-mentioned, when a plurality of recesses are provided at the guide grooves at longitudinally spaced intervals, the positions of engagement of the recesses with the projections can be selected so that the seal blade can be kept away from or come in contact with the surface of the photosensitive drum. Such arrangement can eliminate various problems occurred at a time when the seal blade is in contact with the photosensitive drum for a long period of time.

In a toner collecting apparatus in accordance with a still further embodiment of the present invention, restraining pieces for restraining the tip portion of the seal blade from being bent are disposed between the seal blade and the toner feeding member with a gap between the seal blade and the restraining pieces.

According to the toner collecting apparatus above-mentioned, even though copying paper entering the toner collecting apparatus presses the seal blade toward the toner feeding member, the seal blade comes in contact with the restraining pieces to restrain the displacement of the seal blade, thereby to prevent the seal blade from being bent. Therefore, only the tip portion of the seal blade is slightly displaced toward the toner feeding member, to prevent the seal blade from being rolled in the toner feeding member. The mere addition of the restraining pieces can provide an economical and simple structure capable of preventing the seal blade from being rolled in.

DETAILED DESCRIPTION OF THE PREFERRED EMBODIMENTS

Figure 1:
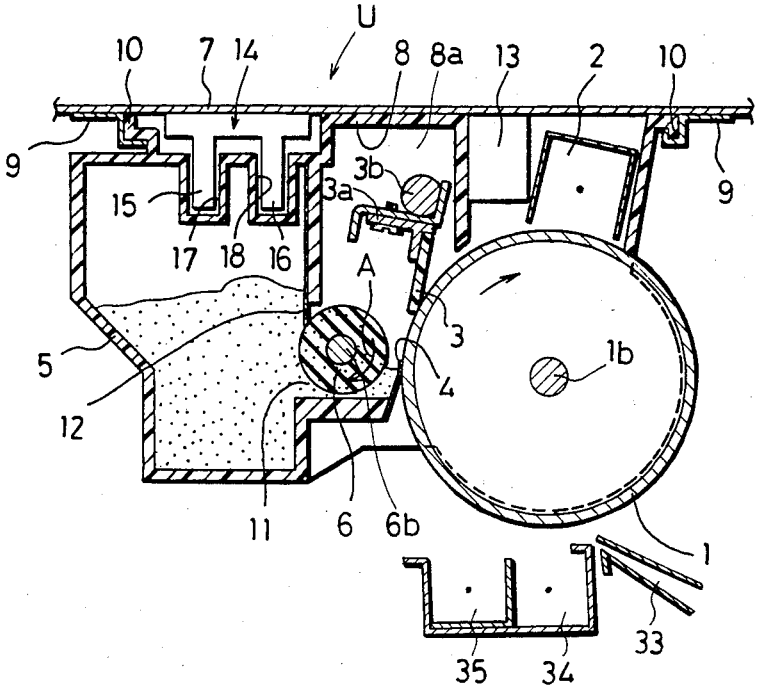
FIG. 1 is a schematic longitudinal section view illustrating a toner collecting apparatus in accordance with an embodiment of the present invention.

The present invention will be described in detail with reference to the attached drawings which illustrate preferred embodiments.

In the drawings, like members are designated by like reference numerals.

The toner collecting apparatus in accordance with the present invention comprises a photosensitive drum 1 having a surface of a selenium photosensitive layer on which an electrostatic latent image is to be formed, an electrifying charger 2 for electrifying the photosensitive drum 1 by corona discharge, a cleaning blade 3 having a tip which comes in contact with the surface of the photosensitive drum 1 and is adapted to scrape away toner remaining on the surface of the photosensitive drum 1, a seal blade 4 for receiving toner scraped away which is disposed opposite to the cleaning blade 3 and has a tip in contact with the surface of the photosensitive drum 1, a toner collecting container 5 for collecting toner scraped away, and a sponge roller 6 as a toner feeding member between the photosensitive drum 1 and the toner collecting container 5 for conveying toner scraped away to the toner collecting container 5.

This toner collecting apparatus is removably attached to the main body 7 of a copying machine. A housing 8 of the toner collecting apparatus has two lateral plates 8*a*, 8*b*. Integrally attached to the both lateral plates 8*a*, 8*b* are a rotating shaft 1b of the photosensitive drum 1, the electrifying charge 2, a shaft 3*b* which the cleaning blade 3 is secured through a mounting member 3*a*, the seal blade 4 and a shaft 6*b* of the sponge roller 6. The toner collecting container 5 is integrally formed with the lateral plates 8*a*, 8*b*. These members above-mentioned constitute a photosensitive unit U. In order to slidably mount this toner collecting apparatus on the main body 7 of a copying machine, the housing 8 has at predetermined positions flanged portions 10 which engage with guide rails 9 of the main body 7 of a copying machine. The cleaning blade 3 and the seal blade 4 may be made of a elastic material having flexibiliy such as polyurethane in order to prevent the surface of the photosensitive drum 1 from being damaged.

The toner collecting container 5 has, at the lower portion of the lateral wall thereof adjacent the photosensitive drum 1, a toner receiving port 11. Between this toner receiving port 11 and the photosensitive drum 1, there is rotatably mounted the sponge roller 6 made of a porous material which can be elastically deformed. This sponge roller 6 is rotatable in the direction from the lower end to the upper end of the toner receiving port 11 (in the clockwise direction shown by an arrow A in FIG. 1). At the inner side of the lateral wall above-mentioned of the toner collecting container 5, there is mounted a scraping plate 12 of which the lower end is located in the toner receiving port 11 and pressure-contacted with the outer peripheral surface of the sponge roller 6.

Attached to the main body 7 of a copying machine is a discharging lamp 13 for removing residual electric charge remaining on the photosensitive drum 1.

An optical sensor 14 is attached to the main body 7 of a copying machine at a position opposite to the top surface of the toner collecting container 5. The toner collecting container 5 has, in its top surface at predetermined positions, concaved portions 17, 18 into which a light emitting portion 15 and a light receiving portion 16 of the optical sensor 14 are respectively inserted. Between the light emitting portion 15 and the light receiving portion 16, there is formed at light passage constituted by the side wall of the concaved portion 17, the inner space of the toner collecting container 5 and the side wall of the concaved portion 18. Those portions of the concaved portions 17, 18 which are located between the light emitting portion 15 and the light receiving portion 16, may be made of a light-permeable transparent material such as glass or plastic.

According to the toner collecting apparatus above-mentioned, toner remaining on the surface of the photosensitive drum 1 after the development and transfer operations (not shown) have been finished, is scraped away by the cleaning blade 3. The toner thus scraped away spontaneously falls between the sponge roller 6 and the seal blade 4. Since the sponge roller 6 is rotated at all times in the clockwise direction shown by the arrow A, the falling toner enters small holes in the sponge roller 6 and is conveyed by the sponge roller 6 up to a position where the toner is pressure- contacted with the scraping plate 12. At such position, the toner is forcibly pressed out from the small holes in the sponge roller 6 and then guided into the inside of the toner collecting container 5. For example in a copying machine, such operations are made each time a copying operation is carried out, and the amount of toner collected in the toner collecting container 5 is gradually increased.

While such operations are being made, whether or not the amount of toner collected has reached a predetermined amount can be judged based on whether or not the light passage between the light emitting portion 15 and the light receiving portion 16 of the optical sensor 14 is intercepted by the toner. That is, toner guided into the inside of the toner collecting container 5 hardly falls spontaneously or, even if any, the falling distance is small. Therefore, toner does not scatter up to a height corresponding to the light passage. Accordingly, there is no possibility of the light passage being obstructed at a time when the amount of toner collected is small. On the other hand, when the amount of toner is increased, since toner is sent into the toner collecting container 5 from the lower portion thereof through the toner receiving port 11, the level of the toner collected is merely increased gradually as the amount of toner collected is increased. Therefore, the light passage is never obstructed due to the scattering of toner. Only when the top surface of collected toner actually obstructs the light passage as the result of increase in the amount of collected toner, It is judged that the amount of toner collected has reached a predetermined amount. Such arrangement securely prevents erroneous detection of the optical sensor 14 due to scattering toner and assures accurate detection of collection of a predetermined amount of toner.

When the optical sensor 14 detects that the amount of toner collected has reached a predetermined amount, the housing 8 is operated to pull out the electrifying charger 2, the cleaning blade 3, the toner collecting container 5 and the sponge roller 6 integrally from the main body 7 of a copying machine. A copying operation or the like can be then continued.

When the toner feeding member is made of the sponge roller 6, toner which has entered small holes in the sponge roller 6, can be pressed out by the scraping plate 12 and guided into the inside of the toner collecting container 5. Such arrangement prevents toner from scattering, in spite of the rotation of the sponge roller 6, even though the amount of toner collected is small. Such arrangement also assures to guide toner into the toner collecting container 5 when the amount of toner collected is increased.

Instead of the sponge roller, there can be used a metallic roller electrified in the polarity opposite to the polarity of toner electric charge, i.e., a metallic roller electrified in the negative polarity for toner electrified in the positive polarity, or a metallic roller electrified in the positive polarity for toner electrified in the negative polarity. Suitable toner may be selected according to the material of photosemiconductors constituting the photosensitive layer of the photosensitive drum 1, such as selenium, zinc oxide, organic photosemiconductors of the polyvinyl carbazole type. As such toner, there may be used (a) two-component toner including iron powder or the like and triboelectrifiable powder containing colorant such as carbon blacks, orgagnic polymers and dyestuffs or the like, or (b) one-component toner mainly containing ferrites and waxes or the like.

In the embodiment above-mentioned, the sponge roller 6 made of a porous material or sponge to be elastically deformed is used as the toner feeding member for sending toner into the toner collecting container. Instead of such sponge roller 6, a brush roller or a rotatable plate member can also be used.

The toner collecting container may be formed separately from the housing and rotatably mounted on the housing. The optical sensor may be mounted in such manner as not to obstruct the rotation of the toner collecting container. With the toner collecting container rotated in such direction as to part from the photosensitive drum, the toner collecting container may be slided on the main body. With such arrangement, the toner collecting container alone or the toner collecting container together with the sponge roller may be taken out, so that only the collected toner can be thrown away. Further, the toner receiving port may be formed at the lowest portion of the side wall of the toner collecting container. At least a portion of that part of the toner collecting container between the light emitting portion 15 and the light receiving portion 16 may be made of a light-permeable material. Only the concaved portions of the toner collecting container may be transparent.

Figure 2:
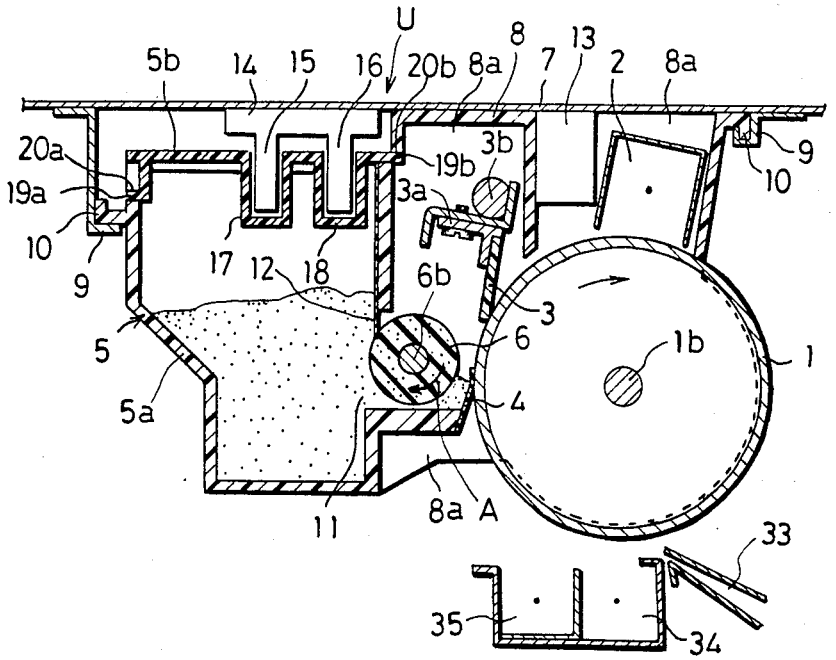
FIG. 2 is a schematic longitudinal section view illustrating a toner collecting apparatus in accordance with another embodiment of the present invention.

As shown in FIG. 2, the toner collecting container 5 may be comprised a container body 5*a* and a lid 5*b* for covering the container body 5*a*. The toner collecting container 5 has a volume sufficient to house the total amount of toner collected when the photosensitive drum has been used as much as the lifetime number of rotations. The lid 5*b* may be made of a light-permeable material such as transparent plastic. The lid 5*b* has at its opposite ends projecting engagement pieces 19*a*, 19*b*, while the container body 5*a* has engagement holes 20*a*, 20*b*. The lid 5*b* is removably attached to the opening of the container body 5*a* with the engagement pieces 19*a*, 19*b* of the lid 5*b* engaged with the engagement holes 20*a*, 20*b* of the container body 5*a*. The lid 5*b* has a pair of groove-shape concaved portions 17, 18 which are concaved toward inside of the container body 5*a*. The light emitting portion 15 and the light receiving portion 16 of an optical sensor 14 are respectively inserted into the concaved portions 17, 18. The optical sensor 14 is so constructed as to detect that the amount of toner collected in the toner collecting container 5 has reached a predetermined amount. There is also disposed a toner amount display for indicating, by light emitting means or the like, that the amount of toner collected has reached a predetermined amount when it is detected.

Figure 3:
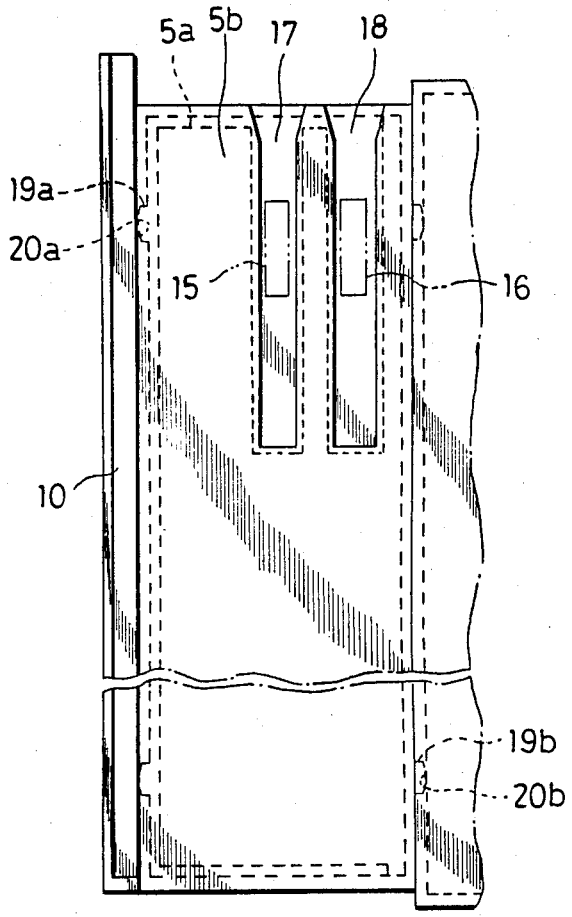
FIG. 3 is a partial plan view of a toner collecting container in FIG. 2.

Likewise the embodiment mentioned earlier, the optical sensor 14 is mounted on the main body 7 of a copying machine. As shown in FIG. 3, the concaved portions 17 and 18 are open at their ends at the rear side of the main body 7. Accordingly, when the photosensitive unit U is set to the main body 7 by sliding the photosensitive unit U in the axial direction of the photosensitive drum 1, the light emitting portion 15 and the light receiving portion 16 are inserted in the concaved portions 17, 18.

Figure 4:
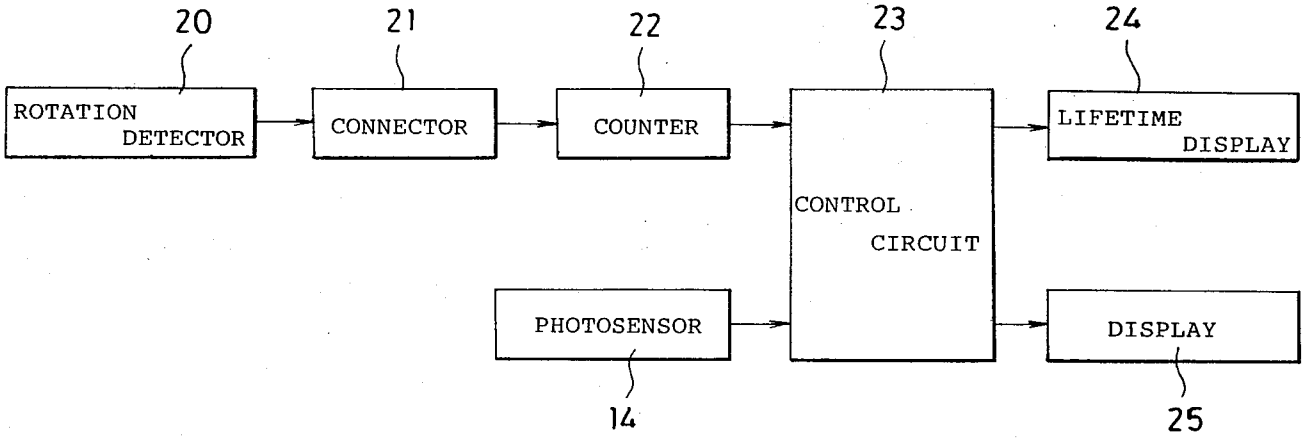
FIG. 4 is a block diagram illustrating a detector mechanism for detecting the number of actual rotations of a photosensitive drum and the amount of toner collected in the toner collecting container.

FIG. 4 is a block diagram of a mechanism for detecting and displaying the number of transfers made for transferring a toner image on the photosensitive drum 1 to copying paper, that is the number of rotations of the photosensitive drum 1, and the amount of toner collected in the toner collecting container 5.

In this detector and display mechanism, a rotation detector 20 for detecting the rotation of the photosensitive drum 1 is connected to a counter 22 through a connector 21. An output signal from this counter 22 and an output signal from the optical sensor 14 are transmitted to a control circuit 23 such as a microprocessor. An output signal from the control circuit 23 is applied to a lifetime display 24 for indicating by light emission or the like that the number of actual rotations of the photosensitive drum 1 has reached its lifetime number of rotations. This lifetime display 24 is disposed at the photosensitive unit U or the main body 7. An output signal from the control circuit 23 is applied to a display 25 for indicating the amount of toner collected, by light emission or the like. This display 25 is adapted to indicate that the amount of toner collected in the toner collecting container 5 has reached a predetermined amount.

In such arrangement, residual toner on the photosensitive drum 1 is scraped away by the cleaning blade 3 and falls inside of the seal blade 4 and sticks to the sponge roller 6. The toner thus sticking to the peripheral surface of the sponge roller 6 is scraped away by the scraping plate 12 with the rotation of the sponge roller 6 and then housed in the toner collecting container 5. Each time the photosensitive drum 1 is rotated, the rotation detector 20 detects the number of rotations of the photosensitive drum 1 and a signal detected is applied to the counter 22. When the number of rotations of the photosensitive drum 1 reaches its lifetime number of rotations, the counter 22 supplies a signal to the control circuit 23. An output signal from the control circuit 23 is then applied to the lifetime display 24, which indicated, in turn, that the number of actual rotations of the photosensitive drum 1 has reached its lifetime number of rotations.

On the other hand, when the amount of toner collected in the toner collecting container 5 is increased such that the top level of toner collected reaches between the concaved portions 17 and 18 of the lid 5b, light from the light emitting portion 15 of the optical sensor 14 is obstructed, so that the optical sensor 14 supplies a signal to the control circuit 23. The control circuit 23 then supplies a signal to the toner amount display 25, which indicates, in turn, that the amount of toner collected in the toner collecting container 5 has reached a predetermined amount.

When the number of actual rotations of the photosensitive drum 1 has not reached yet its lifetime number of rotations even though the display 25 indicates that the amount of toner in the toner collecting container 5 has reached a predetermined amount, the lid 5*b* may be removed and a suitable amount of toner in the container body 5*a* may be taken out to provide, in the toner collecting container 5, a space for housing scraped toner. Then, the lid 5*b* is put on the container body 5*a*. At this time, toner sticking to the opposite surfaces of the concaved portions 17, 18 is removed to assure a light passage of the optical sensor 14. The photosensitive unit U is then mounted on the body 7 of a copying machine, which can be continuously used. When the lifetime display 4 indicates that the number of actual rotations of the photosensitive drum 1 has reached its lifetime number of rotations, the photosensitive unit U is to be replaced. Such arrangement eliminates the replacement of the photosensitive drum 1 which can be still fit for use, thereby to reduce the cost to be borne by the user.

In this embodiment above-mentioned a photosensor is used as the optical sensor 14, there can be used any sensor of other type which can detect that the amount of toner collected in the toner collecting container 5 has reached a predetermined amount, such as a pressure sensor for detecting, based on the weight of toner in the toner collecting container 5, that the amount of toner in the toner collecting container 5 has reached a predetermined amount. In such case, a sensor can be mounted on the container body 5*a* at its suitable position dependent on the type of a sensor to be used.

The lid 5*b* may be mounted on the container body 5*a* in such manner as to be opened or closed, with any means such as hinges. In this embodiment, toner in the toner collecting container 5 can be taken out with the lid 5*b* removed. The lid 5*b* or the container body 5*a* may have a hole through which toner in the toner collecting container 5 can be taken out.

Instead of the cleaning blade 3, there may be used any cleaning means capable of cleaning residual toner on the photosensitive drum 1. Any choice may be made as to the construction of the toner collecting container 5, the mounting means of the seal blade 4 and the mounting means of the photosensitive unit U on the main body 7. The photosensitive drum 1 and the toner collecting container 5 can be connected to each other by any integrally connecting means.

Figure 5:
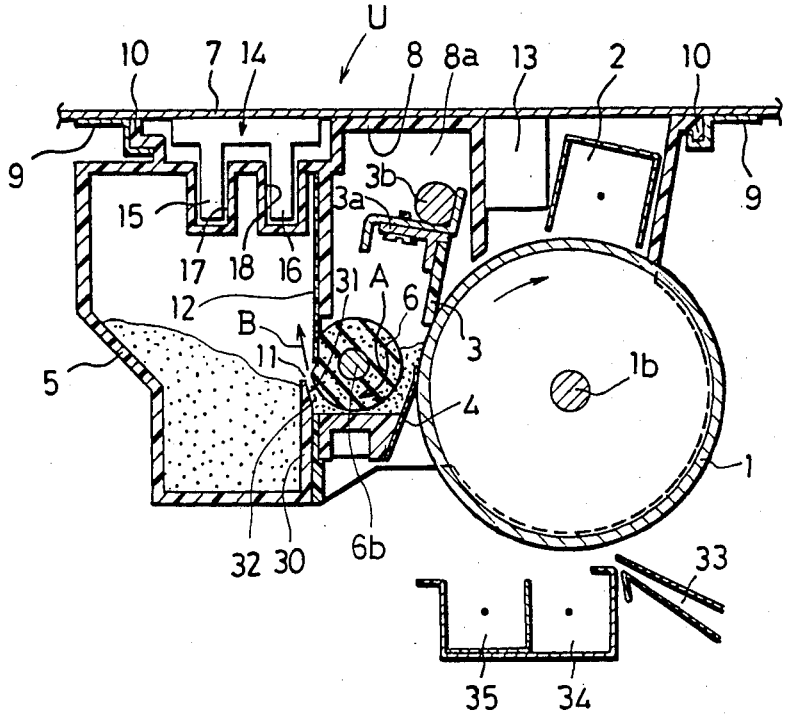
FIG. 5 is a schematic longitudinal section view illustrating a toner collecting apparatus in accordance with another embodiment of the present invention.
Figure 6:
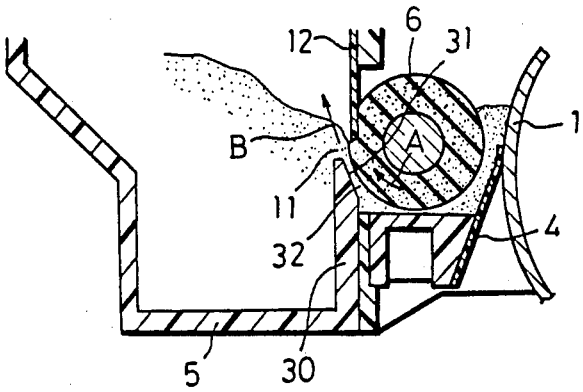
FIG. 6 is an enlarged longitudinal section view of the main portions in FIG. 5.

Another embodiment of the toner receiving port 11 is shown in FIGS. 5 and 6. In this embodiment, the scraping plate 12 secured to that side wall of the toner collecting container 5 in which the toner receiving port 11 is formed, is made of a relatively thin plate, and a lower wall 30 is made of a relatively thick plate. The upper end of the lower wall 30 is inclinedly cut at its side opposite to the sponge roller 6, thereby to present an inclined tip face 31. A relatively narrow toner passage 32 is formed between this inclined tip face 31 and the sponge roller 6. The scraping plate 12 is pressure-contacted at the lower end thereof with the sponge roller 6. At this pressure-contact portion, the sponge roller 6 is elastically deformed. The scraping plate 12 may be formed by the upper wall of the toner collecting container 5 adjacent the toner receiving port 11.

A paper feed passage for feeding a copying paper is generally designated by a reference numeral 33. A transfer charger 34 is disposed for transferring a toner image on the photosensitive drum 1 to the copying paper. A separating charger 35 is disposed for separating such copying paper from the photosensitive drum 1.

In the toner collecting apparatus above-mentioned, toner remaining on the surface of the photosensitive drum 1 is scraped away by the cleaning blade 3 and falls between the sponge roller 6 and the seal blade 4. Since the sponge roller 6 is rotated at all time in the direction shown by the arrow A, such falling toner enters small holes in the sponge roller 6 or is influenced by a frictional force from the surface of the sponge roller 6, so that the toner is conveyed. The toner thus conveyed passes through the relatively narrow toner passage 32 between the inclined tip face 31 and the sponge roller 6. The toner is then discharged in a direction shown by the arrow B substantially tangential with respect to the sponge roller 6 by the rotation of the sponge roller 6.

If the amount of toner collected in the toner collecting container 5 is still small, the toner thus discharged falls to and is accumulated on the bottom of the toner collecting container 5. When the amount of toner collected in the toner collecting container 5 is so increased as to close the toner receiving port 11 as shown in FIG. 6, the toner collected in the toner collecting container 5 normally prevents the feeding of toner through the toner receiving port 11. In this embodiment, however, force in a direction tangential with respect to the sponge roller 6 is exerted to toner and such force is applied, substantially uniformly, on the toner which passes through the narrow toner passage 32. Therefore, the toner can be fed into the toner collecting container 5 and substantially the entire volume of the toner collecting container 5 can be utilized for housing toner. Accordingly, even though the distance between the sponge roller 6 and the bottom of the toner collecting container 5 becomes small, the amount of toner to be collected can be increased.

Figure 7:
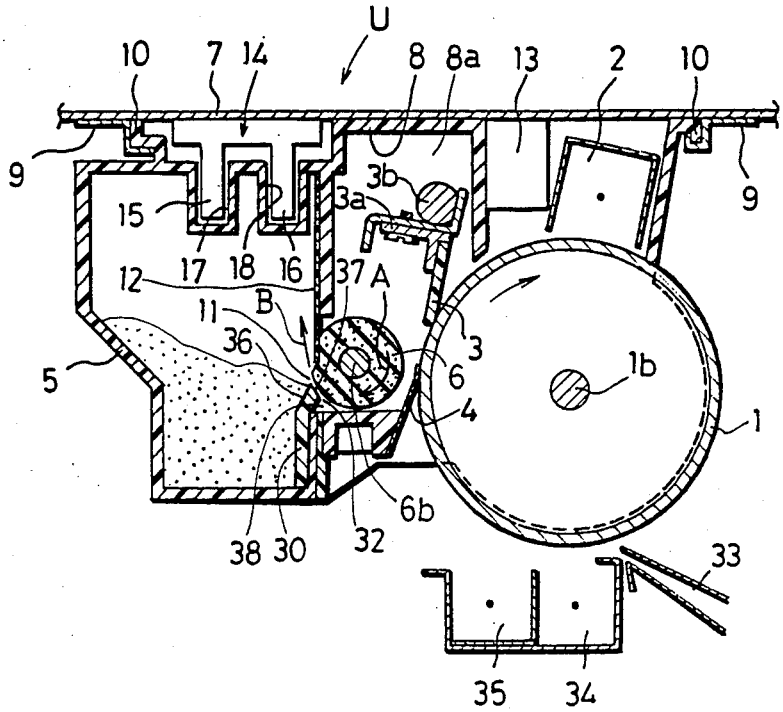
FIG. 7 is a schematic longitudinal section view of a toner collecting apparatus in accordance with still another embodiment of the present invention.
Figure 8:
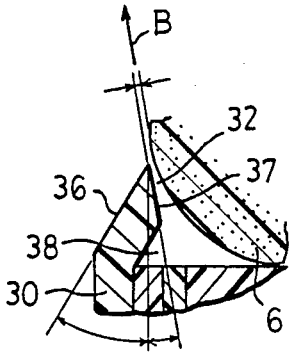
FIG. 8 is a schematic longitudinal section view illustrating the operation to be made when the amount of toner collected is increased.

The toner receiving port 11 can be improved as shown in FIGS. 7 and 8. In this embodiment, the upper end of the lower wall 30 is inclined toward the sponge roller 6 and has inclined face 36 inclined at about 30° to 60°. The tip face 37 of the lower wall 30 is outwardly inclined at about 7° to 13° with respect to a perpendicular plane. The toner passage 32 of about 0.5 to 1.0 mm is formed between the tip face 37 and the sponge roller 6. A concave portion 38 having a triangle section is formed under the tip face 37 of the lower wall 30.

In the toner collecting apparatus in FIGS. 7 and 8, toner spontaneously falling after scraped away by the cleaning blade 3, enters small holes in the sponge roller 6 and receives a frictional force from the surface of the sponge roller 6. Since the sponge roller 6 is rotated at all time in a direction shown by the arrow A, such toner is conveyed and passes through the narrow toner passage 32 between the sponge roller 6 and the tip face 37. The toner is then discharged in a direction B substantially tangential with respect to the sponge roller 6 by the rotation of the sponge roller 6. In this embodiment, the sponge roller 6 having a diameter of 18 mm is rotated at a peripheral speed of about 80 mm/sec.

Figure 9:
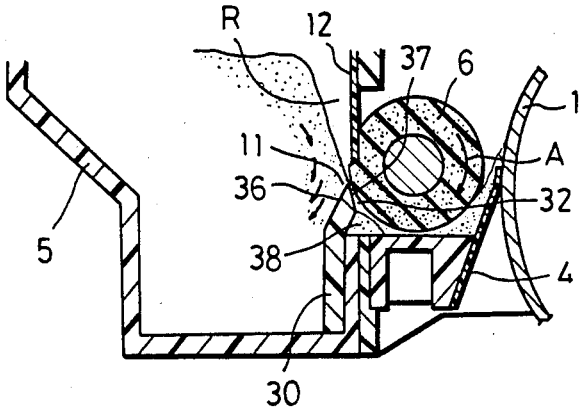
FIG. 9 and FIG. 10 are schematic longitudinal section views illustrating a toner collecting operation.

If the amount of toner collected in the toner collecting container 5 is still small, the toner thus discharged will spontaneously fall to and be accumulated on the bottom of the toner collecting container 5. Then, the amount of toner collected in the toner collecting container 5 will be increased and accumulated to a level higher than the toner receiving port 11. When such accumulation is increased with the rotation of the sponge roller 6 continued, as shown in FIG. 9 toner accumulation can be securely prevented in an area R of about 5° based on the toner passage 32.

Figure 10:
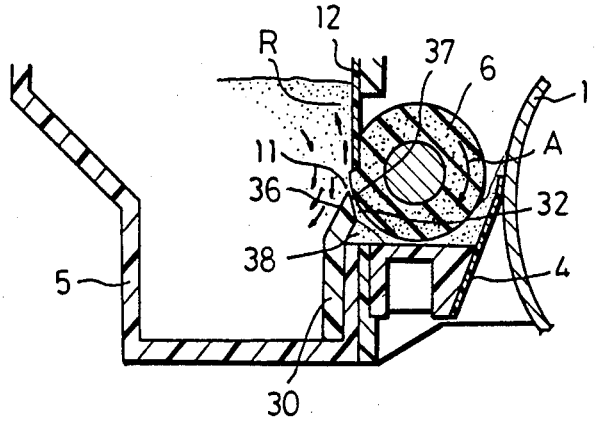

When the rotation of the sponge roller 6 is stopped after toner has been accumulated to a level higher than the toner receiving port 11, toner is accumulated also in the area R as shown in FIG. 10. However, the density of the toner in this area R is low so that a downward force due to the dead load of the toner is hardly exerted. Therefore, the rotation of the sponge roller 6 enables toner to be fed in the toner collecting container 5 without substantial resistance. By the smooth feeding of toner into the toner collecting container 5, the density of the toner in the concave portion 38 can be maintained toner collecting container 5 can be utilized for housing toner, to increase the amount of toner to be collected.

Figure 11:
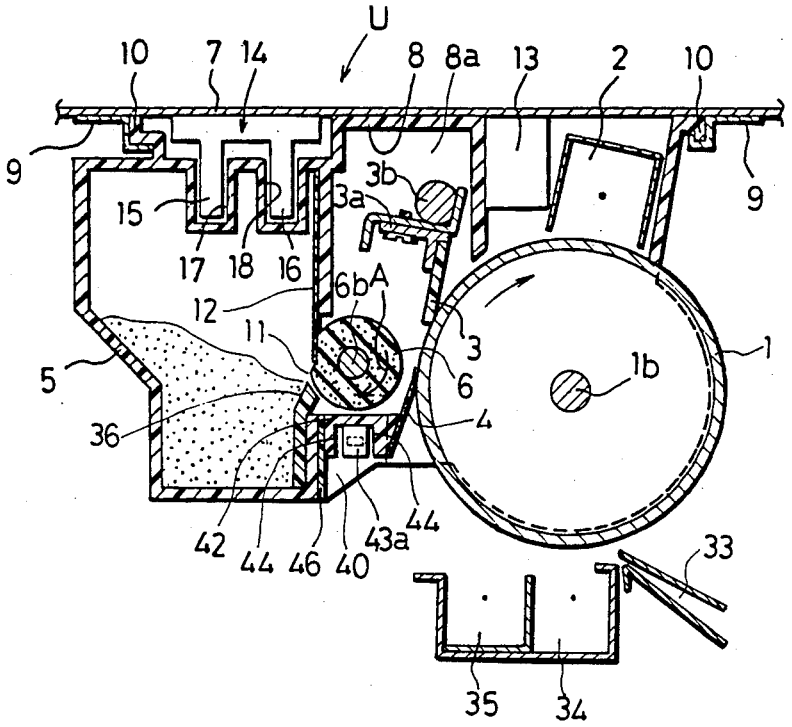
FIG. 11 is a schematic longitudinal section view of a toner collecting apparatus in accordance with yet another embodiment of the present invention.
Figure 12:
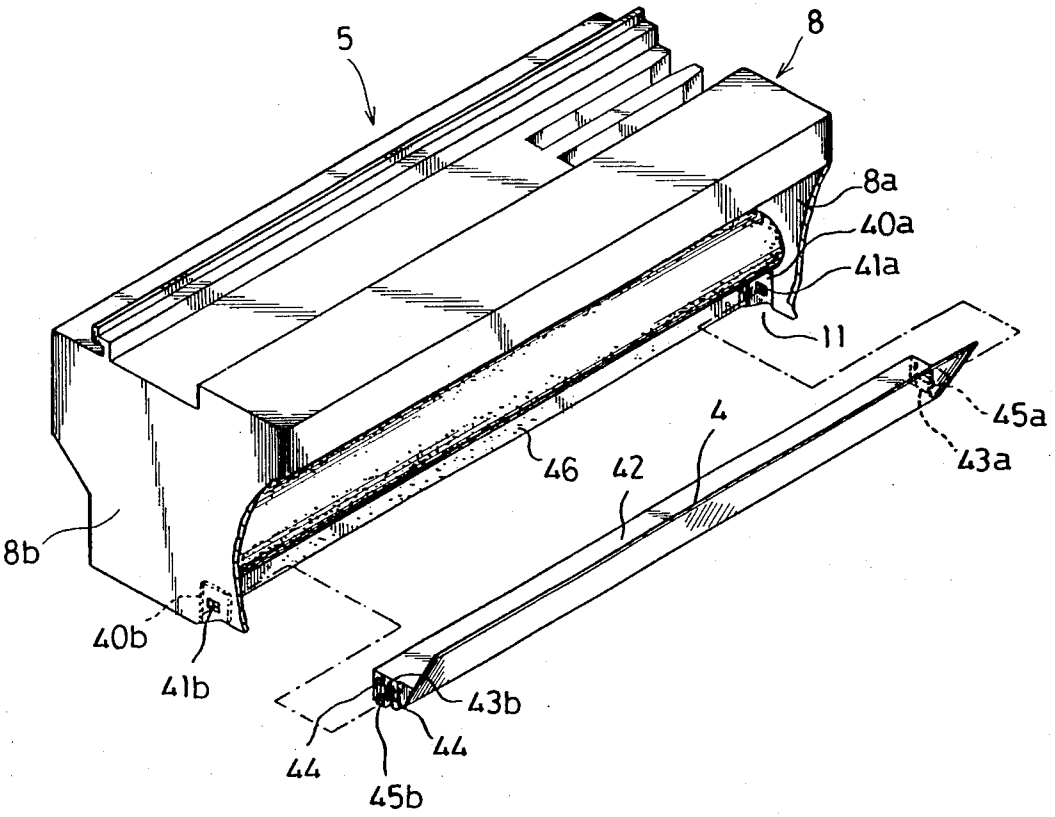
FIG. 12 is a disassembled perspective view of a toner collecting container and a blade holder in FIG. 11.
Figure 13:
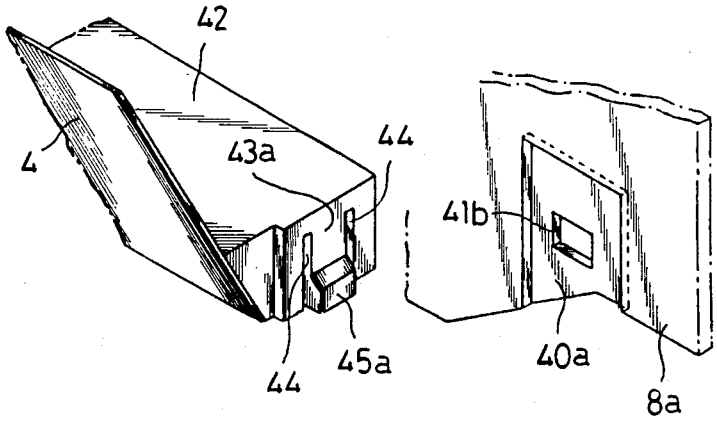
FIG. 13 is a disassembled perspective view of main portions in FIG. 11.

FIG. 11 to FIG. 13 show a still further embodiment of the present invention which employs a mechanism for readily and securely mounting the toner collecting apparatus on the main body of a copying machine.

In this embodiment, the housing 8 has two lateral plates 8a, 8b provided at the inner surfaces of the lower ends thereof with guide grooves 40a, 40b, as guide portions, which have recesses 41a, 41b or through-holes respectively.

The tip of the seal blade 4 made of a polyurethane sheet or the like comes in contact with the surface of the photosensitive drum 1 and the seal blade 4 is bonded to a blade holder 42 having a reversely concaved section, by means of adhesives or the like. The both ends of the blade holder 42 have a shape and size corresponding to the guide grooves 40a, 40b. The blade holder 42 is provided at both ends thereof with support walls 43a, 43b. Each of the support walls 43a, 43b has a pair of slits 44. The portion between these slits 44 is made as an engagement plate which can be elastically deformed easily. The support walls 43a, 43b are provided at the outer surfaces thereof with projections 45a, 45b which engage the recesses 41a, 41b, respectively. When the projections 45a, 45b are engaged in the recesses 41a, 41b, the upper ends of the blade holder 42 come in contact with the upper ends of the guide grooves 40a, 40b to mount the blade holder 42 on the lateral plates 8a, 8b substantially fixedly.

A sealing sponge 46 is secured to the toner collecting container 5 for sealing the space between the blade holder 42 and the toner collecting container 5 to prevent toner from escaping from the toner collecting apparatus.

At the time of transportation of the above-mentioned toner collecting apparatus, the seal blade 4 and the blade holder 42 are kept removed from the toner collecting container 5. For mounting the seal blade 4 on the toner collecting container 5, both ends of the blade holder 42 are inserted, from the lower end of the toner collecting container 5, into the guide grooves 40a, 40b, and the blade holder 42 is then moved upwardly. When the top surface of the blade holder 42 comes in contact with the upper ends of the guide grooves 40a, 40b, the projections 45a, 45b are engaged in the recesses 41a, 41b, respectively. The blade holder 42 is fixed to the lateral plates 8a, 8b and the tip of the seal blade 4 comes in contact with the peripheral surface of the photosensitive drum 1. In order to remove the seal blade 4 from the toner collecting container 5 for maintenance purposes, for example the support walls 43a, 43b may be elastically deformed to disengage the projections 45a, 45b from the recesses 41a, 41b and the blade holder 42 may be moved downward. Therefore, the seal blade 4 can be readily and securely mounted on the toner collecting container 5 at a predetermined position through the blade holder 42.

Consequently, in this embodiment, the blade holder 42 is removably mounted in the guide grooves 40a, 40b in the lateral plates 8a, 8b in a smoother manner.

The seal blade 4 may be bonded to the blade holder 42 with adhesives, or may be conventionally attached to the blade holder 42 with screws through pressing members as mentioned earlier. Without defining the slits 44, the entire support walls 43a, 43b may be formed integrally with the blade holder 42. The blade holder 42 may be solid and the blade holder 42 may be provided at the both end surfaces thereof with projections 45a, 45b. In these cases too, since the lateral plates 8a, 8b can be elastically deformed, the blade holder 42 may be removably mounted on the toner collecting container 5. At least portions of the projections 45a, 45b may be engaged with the recesses 41a, 41b, and the projection 45 may be formed in a suitable shape, such as a spherical shape. The recesses 41a, 41b may be holes having a bottom.

In contract with this embodiment, the recesses 41a, 41b and the guide grooves 40a, 40b may be formed in both end surfaces of the blade holder 42, while the projections 45a, 45b may be formed on the lateral plates 8a, 8b.

Figure 14:
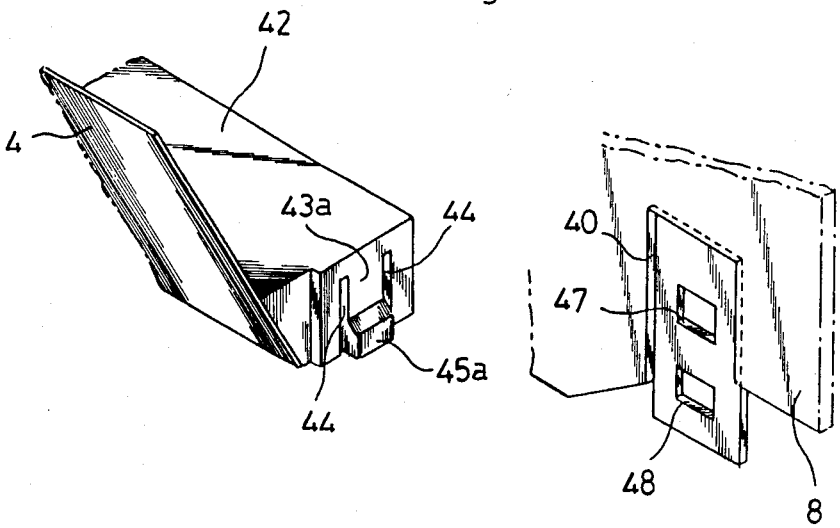
FIG. 14 is a view similar to FIG. 13, but illustrates another example of the main portions.

In an embodiment in FIG. 14, the guide grooves 40 in the lateral plates 8 are longer than the lateral plates 8a, 8b in the embodiment in FIG. 13. At each of the guide grooves 40, there are formed plural recesses 47, 48 at longitudinally spaced intervals.

At the time of transportation, when the projections 45a of the blade holder 42 are enaged in the lower recesses 48, the tip of the seal blade 4 is kept away from the peripheral surface of the photosensitive drum 1. When the blade holder 42 is moved along with the guide grooves 40 and the projections 45a are engaged in the upper recesses 47, the tip of the seal blade 4 comes in contact with the photosensitive drum 1 and can be secured at a predetermined position. Such arrangement of the plural recesses 47, 48 facilitates the handling of the blade holder 42 and the seal blade 4 at the time of transportation or the like of the toner collecting apparatus.

The guide grooves 40a, 40b, 40 may be inclined. In such case, those sides of the guide grooves 40a, 40b, 40 from and into which the blade holder 42 is removed or inserted, are so inclined as to be kept away from the photosensitive drum 1. Such arrangement may reduce friction between the seal blade 4 and the photosensitive drum 1 at a time when the blade holder 42 is removed or attached.

Figure 15:
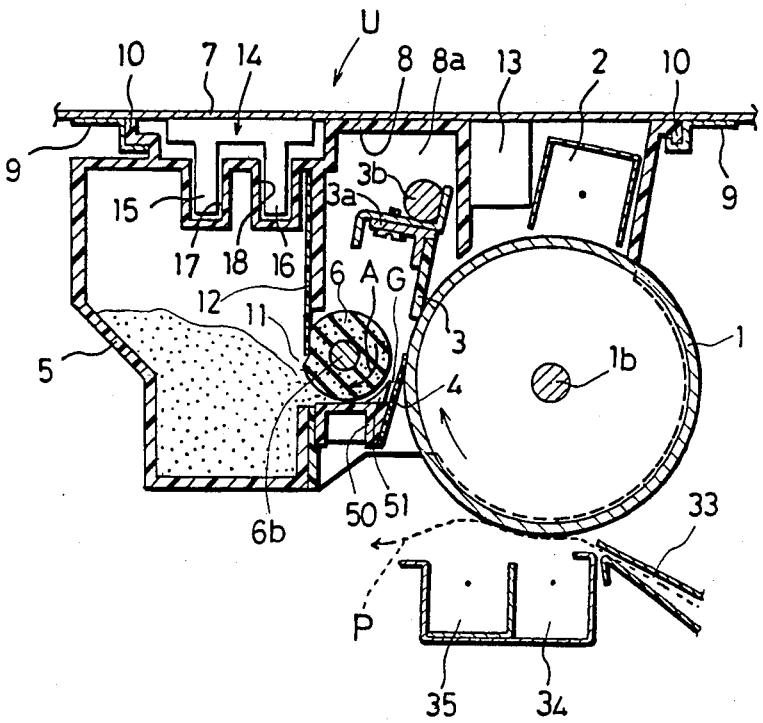
FIG. 15 is a schematic longitudinal section view of a toner collecting apparatus in accordance with a still further embodiment of the present invention.
Figure 16:
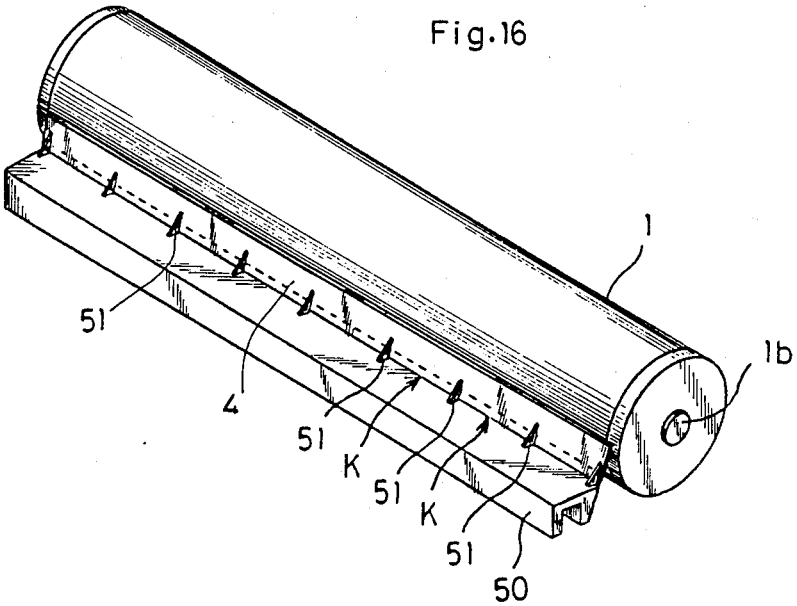
FIG. 16 is a perspective view of the main portions in FIG. 15.
Figure 17:
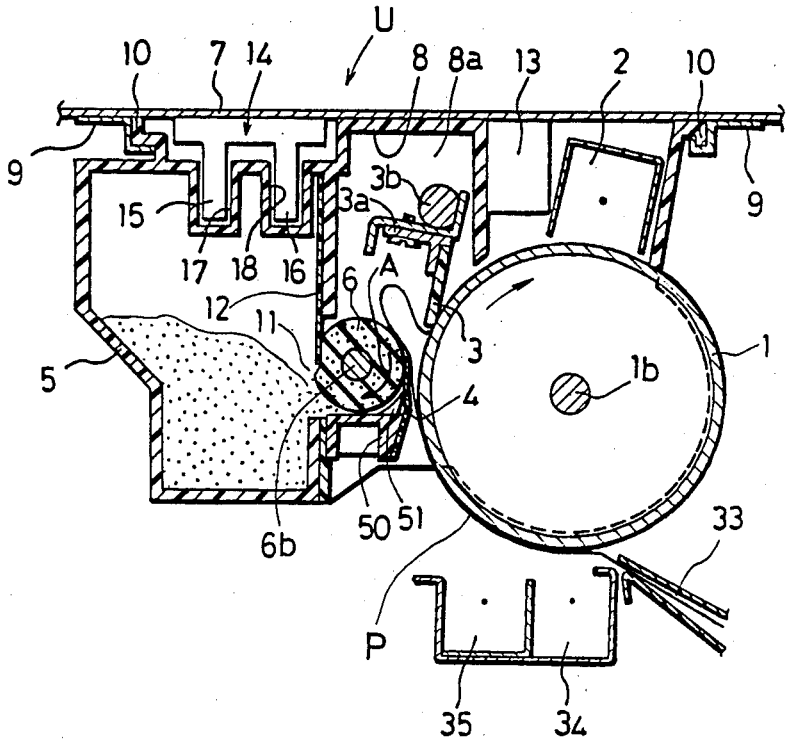
FIG. 17 is a schematic longitudinal section view illustrating how the toner collecting apparatus in FIG. 15 operates.

FIGS. 15 to 17 show an embodiment of the present invention in which, even though copying paper enters the housing to press the seal blade, the seal blade will not be rolled in the sponge roll.

In this embodiment, the cleaning blade 3 is mounted, through the mounting member 3a, on a shaft 3b in parallel with the rotation shaft 1a of the photosensitive drum 1. The shaft 3b is rotatable in the forward and reverse directions by a solenoid (not shown). That is, only when the solenoid is turned ON, does the tip of the cleaning blade 3 come into contact with the surface of the photosensitive drum 1 and scrape away toner remaining on the surface of the photosensitive drum 1. When the solenoid is turned OFF, the tip of the cleaning blade 3 is kept away from the surface of the photosensitive drum 1 by a predetermined distance.

The seal blade 4 has a tip in contact with the surface of the photosensitive drum 1, and a lower end mounted on a blade holder 50.

The shaft 6b of the sponge roller 6 for conveying toner scraped away from the surface of the photosensitive drum 1 by the cleaning blade 3, to the toner collecting container 5, is so disposed as to be in parallel with the rotating shaft 1a of the photosensitive drum 1. The shaft 6b is rotatable in a direction A opposite to the rotating direction of the photosensitive drum 1.

Restraining pieces 51 made of plastic for restraining the tip of the seal blade 4 from being bent are integrally formed with the blade holder 50 between the seal blade 4 and the sponge roller 6. A slight gap G is formed between the restraining pieces 51 and the seal blade 4. The gap G has a size such that, if copying paper P to which an toner image has been transferred, enters the housing 8 along the photosensitive drum 1 and the tip of the seal blade 4 is pressed toward the sponge roller 6 by such copying paper P, the tip of the seal blade 4 is bent in a natural manner without sudden flexion.

The restraining pieces 51 are disposed at spaced intervals K which serve as passages through which toner scraped away from the surface of the photosensitive drum 1 by the cleaning blade 3 is moved to the downstream side or the sponge roller 6 side.

In the toner collecting apparatus shown in FIGS. 15 to 17, even if copying paper P has not been sufficiently separated from the photosensitive drum 1 by the separating charger 35 and has entered the housing 8 along the photosensitive drum 1 to press the seal blade 4 toward the sponge roller 6, the displacement of the seal blade 4 is restrained by the restraining pieces 51. Therefore, only the tip portion of the seal blade 4 located at a position above the restraining pieces 51 is slightly displaced toward the sponge roller 6, as shown in FIG. 17.

Such toner collecting apparatus having a simple and economical structure to which the restraining pieces 51 are merely added, can prevent the seal blade 4 from being rolled in or from being significantly bent toward the sponge roller 6.

As the restraining pieces 51, any pieces which can prevent the tip portion of the seal blade 4 from being bent, can be used. For example, there can be used rod-shaped members or plate members having toner passages.

It is to be noted that the present invention should not be limited to the preferred embodiments and modifications thereof described above, but various modifications may be made without departing from the scope of the present invention.

What is claimed is:

1. Toner collecting apparatus comprising a photosensitive drum for forming a latent electrostatic image, a cleaning blade for removing toner remaining on the surface of said photosensitive drum, a seal blade for guiding toner removed by said cleaning blade, a toner collecting container having a toner receiving port formed at a predetermined position in a lower side of said container for collecting removed toner therein through said port, a toner feeding member being constructed of a porous material and being located adjacent said toner receiving port for feeding collected toner, said toner feeding member being in continuous pressure contact with an upper edge of said toner receiving port and located adjacent a lower edge of said port and being rotatingly driven in a direction from said lower edge of said toner receiving port to said upper edge thereof, and an optical detector disposed on said toner collecting container, said container having portions made of light-permeable material located in opposition to said optical detector.

2. Toner collecting apparatus as set forth in claim 1, wherein a light emitting portion and a light receiving portion of said optical detector are disposed in a pair of concaved portions formed at an upper portion of said toner collecting container, and at least those portions of said concaved portions located between said light emitting portion and said light receiving portion are made of a light-permeable material.

3. Toner collecting apparatus as set forth in claim 1, wherein said toner feeding member is a sponge roller made of porous material capable of being elastically deformed.

4. Toner collecting apparatus as set forth in claim 1, wherein said apparatus further comprises a blade holder for mounting said seal blade, said toner collecting container further comprises opposite lateral plates near said toner receiving port, and said blade holder further comprises opposing ends, each of said lateral plates being connectable to a corresponding end of said blade holder, one of each of said corresponding plates and ends, being provided with guide grooves having recesses and the other of each corresponding plate and end having projections adapted for engagement within said recesses, whereby said blade holder is capable of being removably mounted on said toner collecting container.

5. Toner collecting apparatus as set forth in claim 4, wherein each of the guide grooves has plural recesses at longitudinally spaced intervals.

6. Toner collecting apparatus comprising a photosensitive drum for forming a latent electrostatic image, a cleaning blade for removing toner remaining on the surface of said photosensitive drum, a seal blade for guiding toner removed by said blade, a toner collecting container having a toner receiving port formed at a predetermined position in a lower side of said container for collecting removed toner therein through said port, a toner feeding member located adjacent said port for feeding collected toner, said toner feeding member being in pressure contact with an upper edge of said toner receiving port and located adjacent an outer surface of said lower edge of said toner receiving port, said lower edge of said toner receiving port having a downwardly including inner surface and said toner feeding member being rotatingly driven in the direction from said lower edge of said lower edge of said toner receiving port to said upper edge thereof, and an optical detector disposed on said toner collecting container, said container having portions made of light-permeable material located in opposition to said optical detector.

7. Toner collecting apparatus as set forth in claim 6, wherein said toner feeding member is a sponge roller made of a porous material capable of being elastically deformed.

8. Toner collecting apparatus as set forth in claim 6, further comprising restraining pieces for restraining the tip portion of the seal blade, said restraining pieces being disposed between said seal blade and said toner feeding member whereby a slight gap exists between said seal blade and said restraining pieces.

* * * * *